US007806170B2

(12) United States Patent
Nakamura

(10) Patent No.: US 7,806,170 B2
(45) Date of Patent: Oct. 5, 2010

(54) HEAT EXCHANGER

(75) Inventor: Yoichi Nakamura, Nagoya (JP)

(73) Assignee: T. Rad Co., Ltd., Tokyo (JP)

( * ) Notice: Subject to any disclaimer, the term of this patent is extended or adjusted under 35 U.S.C. 154(b) by 105 days.

(21) Appl. No.: 11/660,468

(22) PCT Filed: Jul. 20, 2005

(86) PCT No.: PCT/JP2005/013688

§ 371 (c)(1),
(2), (4) Date: Feb. 15, 2007

(87) PCT Pub. No.: WO2006/018953

PCT Pub. Date: Feb. 23, 2006

(65) Prior Publication Data

US 2007/0246207 A1 Oct. 25, 2007

(30) Foreign Application Priority Data

Aug. 19, 2004 (JP) ..... 2004-239337

(51) Int. Cl.
*F28F 9/02* (2006.01)

(52) U.S. Cl. ..... 165/158; 165/175

(58) Field of Classification Search ..... 165/173, 165/175, 158, 166, 167
See application file for complete search history.

(56) References Cited

U.S. PATENT DOCUMENTS

| | | | | |
|---|---|---|---|---|
| 6,016,865 | A * | 1/2000 | Blomgren | 165/148 |
| 6,247,523 | B1 * | 6/2001 | Shibagaki et al. | 165/51 |
| 2001/0047861 | A1 * | 12/2001 | Maeda et al. | 165/167 |
| 2002/0074105 | A1 * | 6/2002 | Hayashi et al. | 165/43 |
| 2003/0010480 | A1 * | 1/2003 | Shibagaki et al. | 165/158 |

FOREIGN PATENT DOCUMENTS

| | | |
|---|---|---|
| DE | 100 60 102 | * 6/2001 |
| JP | 51-134257 | 11/1976 |
| JP | 2-28531 | 2/1990 |
| JP | 3-22963 | 3/1991 |
| JP | 2004-177058 | 6/2004 |

* cited by examiner

*Primary Examiner*—Teresa J Walberg
(74) *Attorney, Agent, or Firm*—Jordan and Hamburg LLP

(57) ABSTRACT

In a heat exchanger having a casing in which a joint of the casing and between a core and the casing are brazed and fixed without a gap, the section of a portion in contact with the casing body is formed at a right angle at both ends of an upper edge portion of a header plate, and an upper lid is fitted so that it is brought into contact with the upper edge of the header plate over the entire length.

1 Claim, 5 Drawing Sheets

HEAT EXCHANGER

BACKGROUND OF INVENTION

The present invention relates to an EGR (Exhaust Gas Recirculation) cooler and various heat exchangers having a casing.

A casing-type heat exchanger used as an EGR cooler is proposed as Japanese Patent No. 3022963. This heat exchanger is comprised, as shown in FIGS. 5 and 6, such that a core 5 is formed by penetrating both ends of a large number of flat tubes arranged in parallel through a header plate 3, the outer circumference of the core 5 is fitted with a box-state first casing 20 and a second casing 21 divided into a pair of upper and lower halves, and a joint or the like of the casings are fixed in an air tight manner by way of welding or the like. And cooling water is made to flow through either of the casing side and the header side while an exhaust gas is made to flow through the other for cooling the gas.

In a conventional casing-type heat exchanger, the upper and lower pair of box-state casings are fitted with the outer circumference of the core as shown in FIGS. 6A and 6B. At the joint portion of the casings, as shown in FIG. 6B, the lower end of the upper member is fitted to the outer circumference of the tip end portion of the lower member, and the both are joined by welding or brazing. There is no problem if the both are joined by welding, but in case of brazing, a gap 22 is generated at the joint portion as shown in FIG. 6B, which could cause defective brazing.

That is, one of the outer surfaces of the pair of box-state casings and the core part is coated by a brazing metal and the whole is integrally brazed and fixed in a furnace. However, if the gap 22 is formed at the joint, the brazing metal is biased to one side and does not penetrate into the other side, which causes lack of brazing. Thus, there has been a problem that air tightness or liquid tightness can not be maintained.

The present invention has an object to prevent occurrence of a gap which tends to be formed in the conventional casing as less as possible and to provide a heat exchanger with reliable brazing.

SUMMARY OF THE INVENTION

The present invention in a first aspect thereof is a heat exchanger comprising:

a casing body (1) made into a box state by deep drawing of press work and whose corners in the cross section are formed in the curved state;

an upper lid (2) formed into a dish state with an edge portion (2*a*) slightly bent on the outer circumference and closing an upper-end opening of the casing body (1) so as to fit therewith; and a core (5) fitted in an intermediate portion of the casing body (1) and in which both ends of a plurality of tubes (4) are inserted/fixed to a pair of header plate (3), and wherein the header plate (3) has a lower edge portion (6), side edge portions (7) and an upper edge portion (8) bent with a section in the inverted L-shape on the outer circumference, the both side edge portions (7) and the lower edge portion (6) conforming to the inner circumferential face of the casing body (1) and the upper edge portion (8) being matched with the upper edge height of the casing body (1), a portion in contact with the casing body (1) at both ends of the upper edge portion (8) has a section at a right angle, and the upper lid (2) is fitted so that it is brought into contact with the upper edge of the header plate (3) over the entire length, and contact portions between each part are integrally brazed/fixed.

according to the first aspect of the invention

The present invention in second aspect thereof is a heat exchanger wherein the header plate (3) has the both side edge portions (7) and the lower edge portion (6) formed by drawing by press work, and the upper edge portion (8) has the both ends formed by cutting and bending work.

The heat exchanger of the present invention is constructed as above and the following effects are exerted.

In the heat exchanger of the present invention in which its heat exchanger core is fitted inside the casing and integrally brazed, each part of the casing and the header plate can be brazed together with a high accuracy, its manufacture and assembling is easy, and mass production performance is high.

That is, the header plate 3 of the core 5 fitted inside the casing body 1 has its outer circumference except the upper edge portion 8 matched with the inner circumference of the casing body 1. And at both ends of the upper edge portion 8, the section of a portion in contact with the casing body 1 is formed at a right angle. Therefore, the upper edge portion 8 and the upper lid 2 can be brought into contact without a gap over the entire length, which ensures air tightness and liquid tightness after brazing.

In the above construction, where the lower edge portion 6 and the side edge portions 7 of the header plate 3 are formed by drawing of press work and the upper edge portion 8 has its both ends formed by cutting and bending work, the both ends can be easily formed at a complete right angle. By this, the upper edge of the header plate 3 and the casing body 1 as well as the upper edge portion 8 and the upper lid 2 can be brought into contact with each other completely without a gap, and brazing accuracy can be maintained higher.

BRIEF DESCRIPTION OF THE DRAWINGS

FIG. 6 illustrates an assembled state of the heat exchanger, in which

DETAILED DESCRIPTION OF THE INVENTION

Figure 1A:
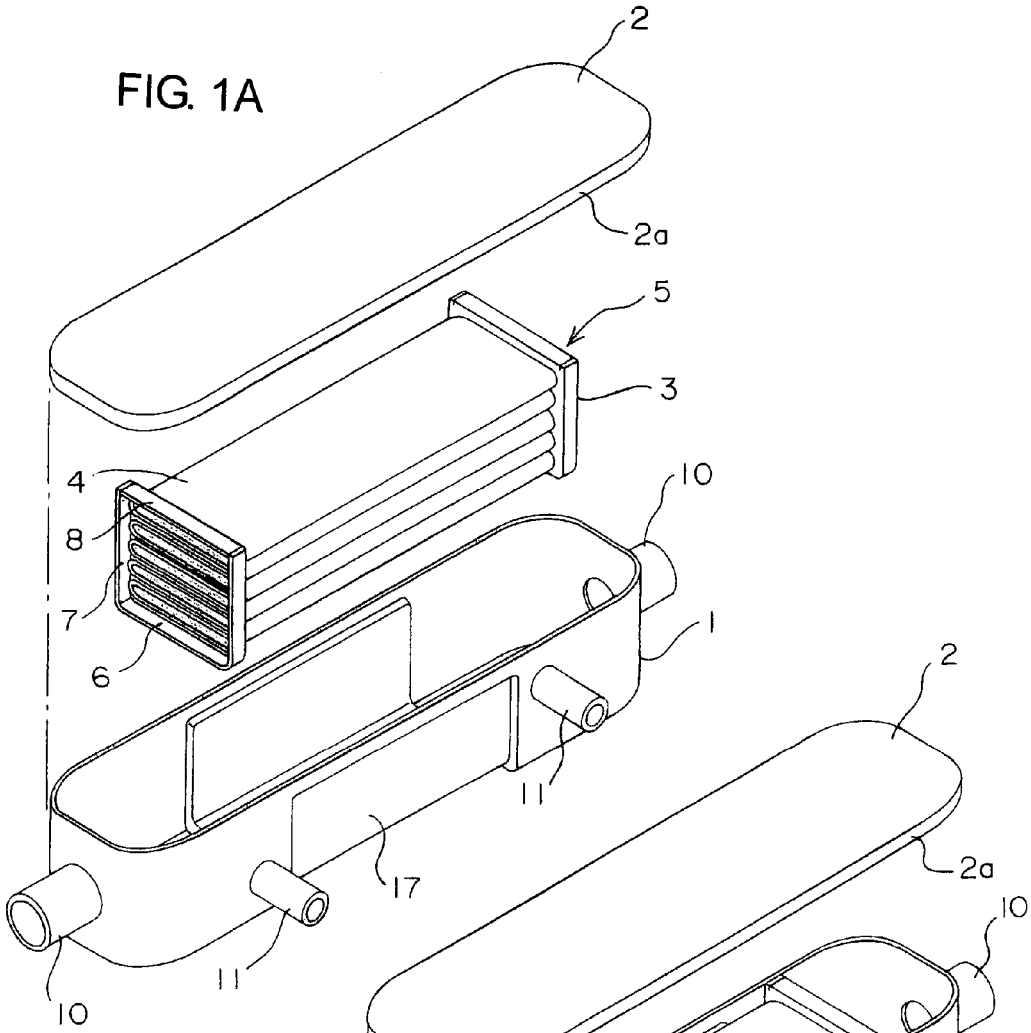
FIG. 1 is an exploded perspective view of a heat exchanger of the present invention.
Figure 1B:
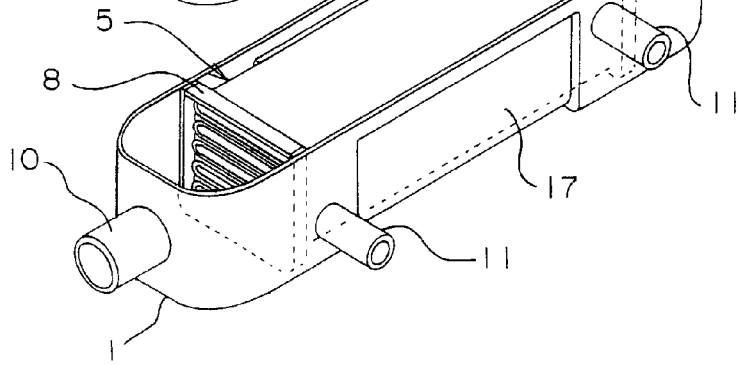
Figure 2A:
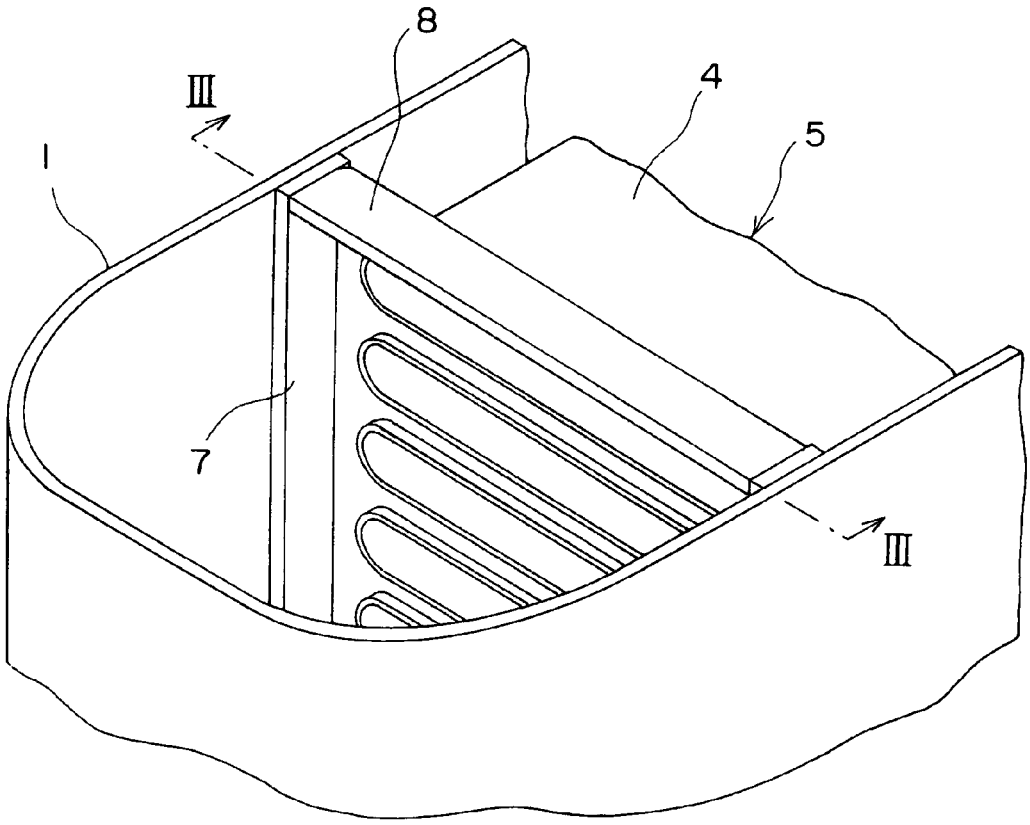
FIG. 2 is a perspective view of an essential part thereof and a perspective view of a header plate 3.
Figure 2B:
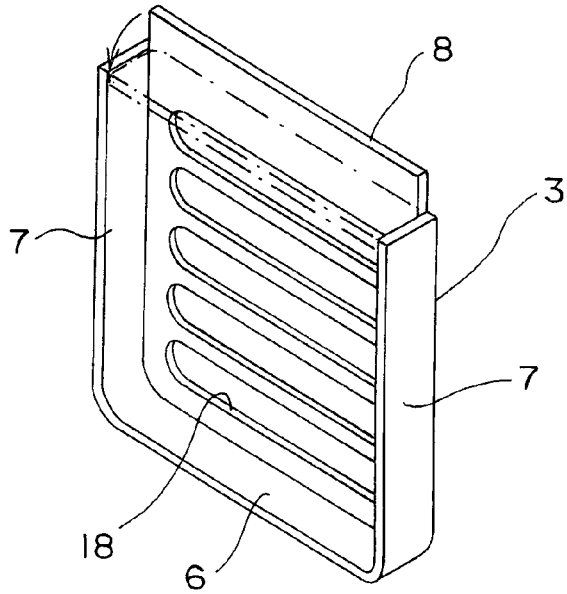
Figure 3:
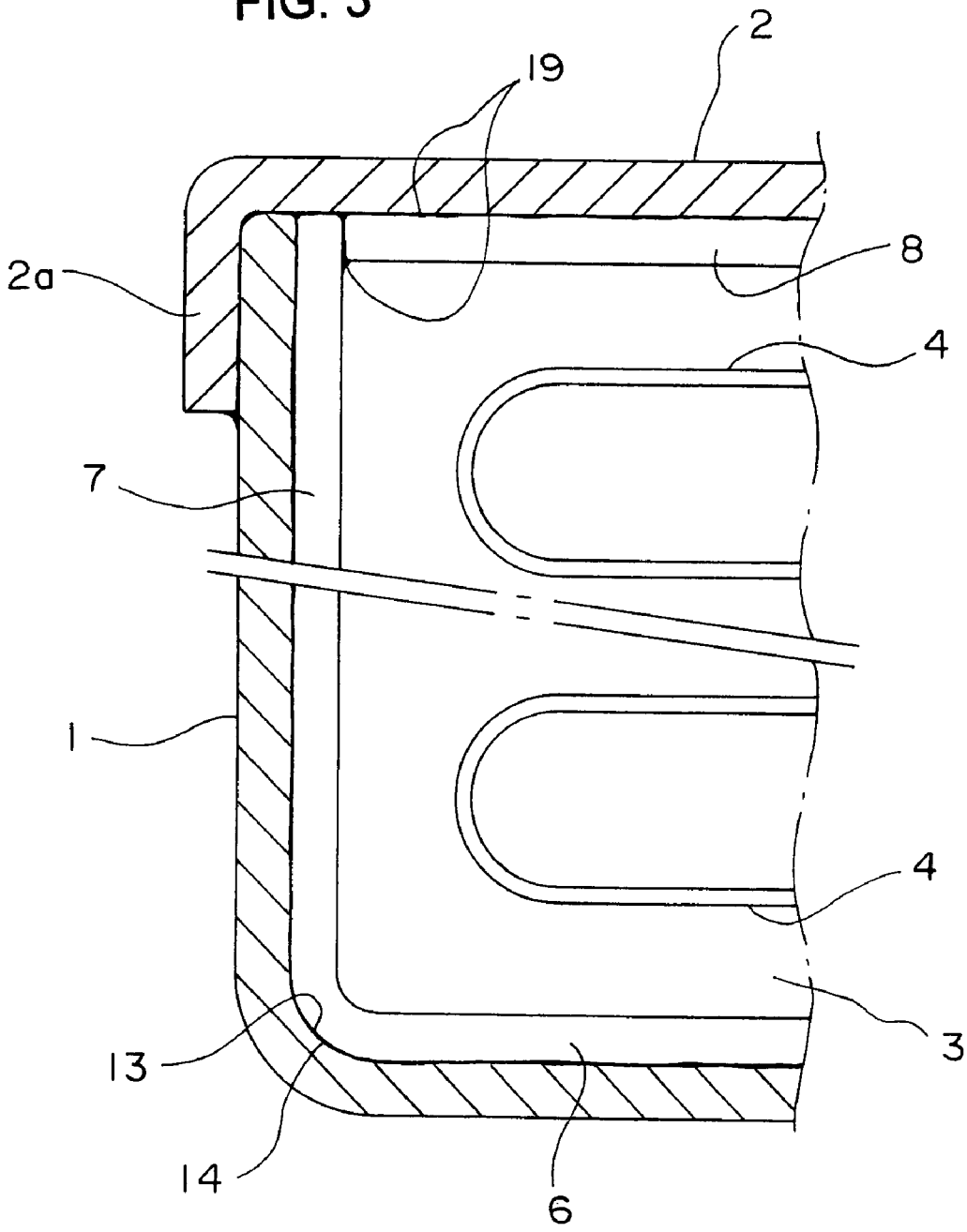
FIG. 3 is a schematic sectional view on arrow III-III in FIG. 2, illustrating an assembled state of the heat exchanger of the present invention.
Figure 4:
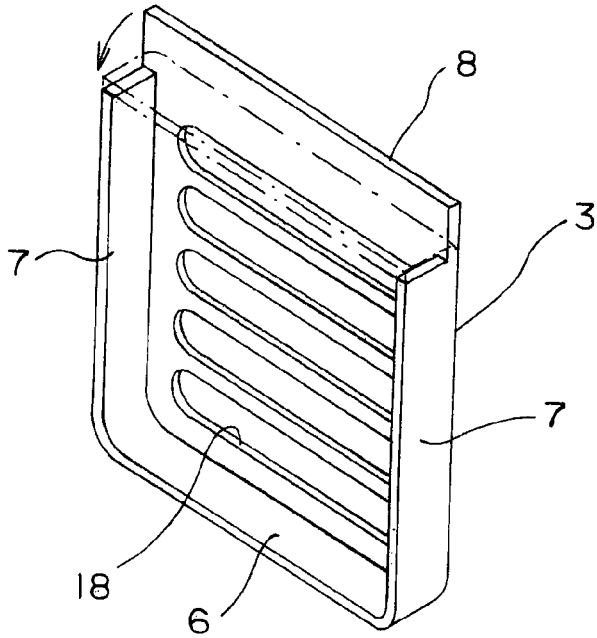
FIG. 4 is a perspective view showing another header plate 3 of the heat exchanger of the present invention corresponding to FIG. 2B.
Figure 5:
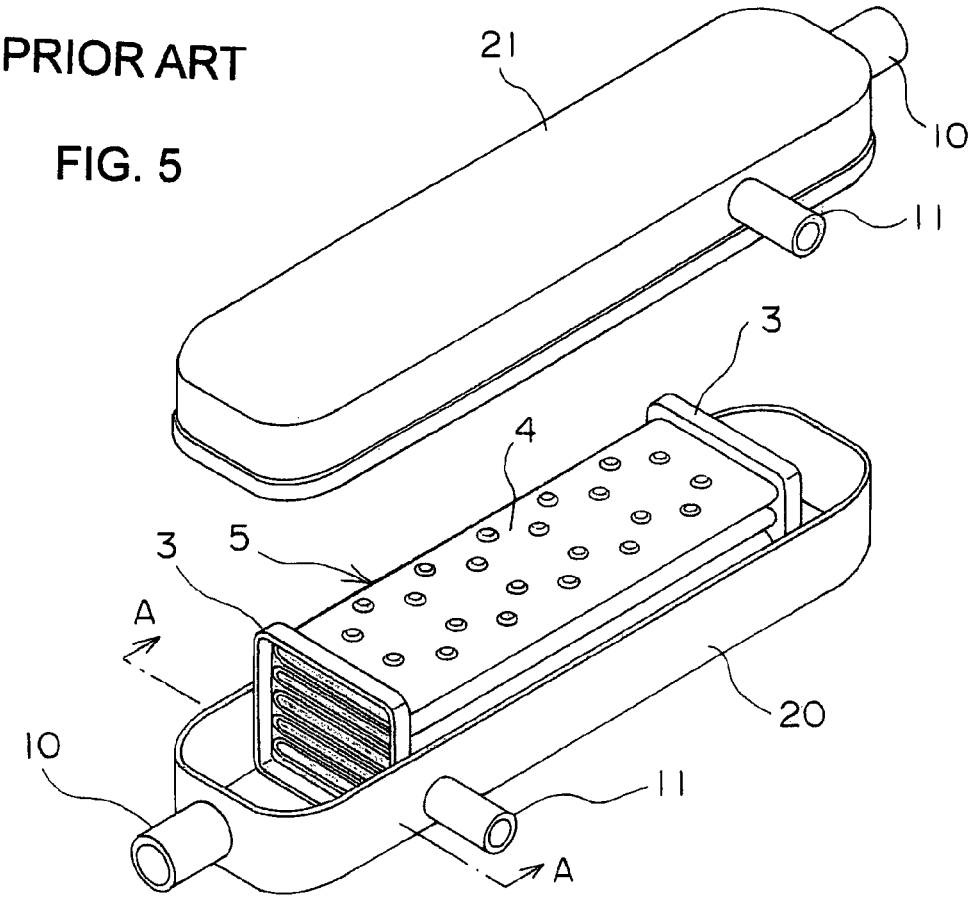
PRIOR ART FIG. 5
FIG. 5 is an exploded perspective view of a conventional heat exchanger.
Figure 6A:
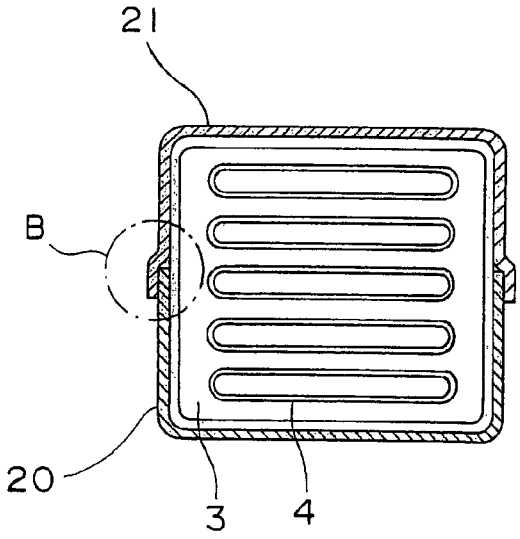
PRIOR ART FIG. 6A
FIG. 6A is a schematic sectional view on arrow A-A in FIG. 5
Figure 6B:
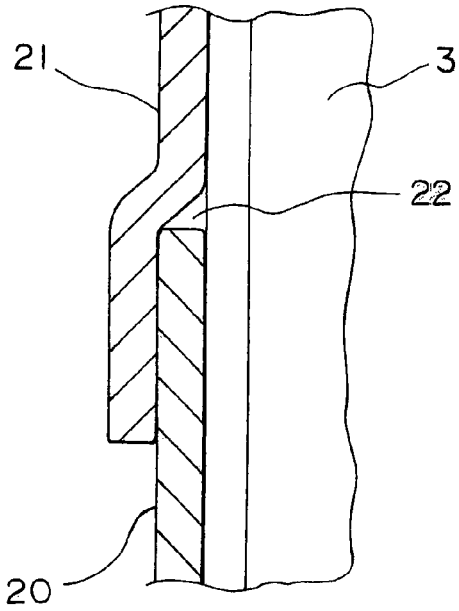
FIG. 6B is an enlarged view of a B part in FIG. 6A.

An embodiment of the present invention will be described below referring to the attached drawings. FIG. 1 is an exploded explanatory view of a heat exchanger of the present invention, in which FIG. 1A shows a state where each essential part is separated, while FIG. 1B is a perspective view showing a state where a core 5 is stored in a casing body 1. FIG. 2A is a perspective view of the essential part of FIG. 1B, and FIG. 2B is an explanatory view illustrating a manufacturing process of a header plate 3. FIG. 3 is an explanatory view showing an assembled state of the heat exchanger and schematic sectional view on III-III arrow in FIG. 2.

This heat exchanger comprises the casing body 1, the core 5 and an upper lid 2. The casing body 1 is formed by deep drawing into a box state by press work, and at the lower edge of the side portion, a curved portion 13 is formed as shown in FIG. 3. Also, as shown in FIG. 1, a recess portion 17 is bent on the intermediate portion on the outer circumference of the casing body 1 and the portion is relatively projected to the inner face side. Moreover, connection holes for a pair of first pipes 10 and second pipes 11 are opened respectively on the end faces in the longitudinal direction and on the side face of the casing body 1.

Next, the core 5 has a large number of flat tubes 4 laminated, and their both ends are inserted to a pair of header plates 3 as shown in FIG. 2A. On the header plate 3, a lower edge portion 6 and side edge portions 7 are provided on the outer circumference as shown in FIG. 2B, which conform to the inner circumference of the casing body 1. An upper edge portion 8 is formed in the plane direction of the header plate 3 as shown in FIG. 2B and turned up by 90 degrees to be formed as shown in FIG. 2A. Instead of FIG. 2B, the width of the upper edge portion 8 may be extended to the outer surfaces of both the side edge portions 7 and turned up by 90 degrees. In any case, the upper edge portion 8 of the header plate 3 conforms to the upper edge of the casing body 1 in the bent state as shown in FIG. 2A.

Each tube 4 is made of a flat tube in this example.

Next, the upper lid 2 has an edge portion 2*a* conforming to the outer peripheral edge of the casing body 1.

Paste braze is applied between each part in contact with each other or the one coated with a brazing metal at least on one outer surface is used. As an example, for an aluminum-made heat exchanger, a brazing sheet clad with a brazing metal of aluminum alloy may be used on at least one of the outer surfaces of aluminum plates constituting each part.

To the both end openings and the side openings of the casing body 1, the first pipes 10 and the second pipes 11 are connected, and the core 5 is inserted into the casing body 1. At this time, the upper face of the upper edge portion 8 and the upper end edge of the side edge portion 7 conform to the upper edge of the casing body 1 as shown in FIG. 2A. In this state, the upper lid 2 is fitted to the casing body 1. At this time, the lower face of the upper lid 2 is brought into contact with the upper ends of the upper edge portion 8 and the side edge portions 7 as well as the upper end edge of the casing body 1. The heat exchanger assembled in this way is inserted into a furnace at a high temperature and integrally brazed and fixed as shown in FIG. 3 by melting the brazing metal on the surface of each part and then, cooling and solidifying it. The inner surface of the upper lid 2 and the upper end edge of the casing body 1 are brought into close contract with each other and the upper face of the upper edge portion 8 and the upper end edges of the side edge portions 7 of the header plate 3 are also brought into contact with the upper lid 2. In such a state, no gap is generated between each part. Therefore, the brazing metal evenly penetrates between the header plate 3 and the upper lid 2 as well as the casing body 1 after brazing, and air tightness and liquid tightness can be maintained.

In this example, a first fluid flows from one of the first pipes 10, flows through each tube 4 and then, is guided to the other of the first pipes 10. Also, a second fluid flows from one of the second pipes 11, flows through the outer surface of each tube 4 and then, flows out of the other of the second pipes 11 so that heat is exchanged between the both fluids.

The invention claimed is:

1. A heat exchanger comprising:

a casing body made into a box state by deep drawing of press work and whose corners in the cross section are formed in the curved state, the entire circumference of an upper peripheral surface portion of the casing body defining an upper-end opening thereof being substantially parallel to edge portions of a bottom face of the casing body;

an upper lid formed into a dish state with an edge portion bent on its outer circumference, fitting with and closing an upper-end opening of said casing body; and a core fitted in an intermediate portion of the casing body and into which both ends of a plurality of tubes are fixed to a pair of header plates, each header plate having two adjacent orthogonal non-radiused corners, and wherein each said header plate has a lower edge portion and two side edge portions formed by drawing of press work, and an upper edge portion cut and bent perpendicularly in an inverted L-shape thereby forming an upper surface of the respective header plates, the both side edge portions and the lower edge portion conforming to the inner circumferential face of the casing body, the side portions and the upper edge portion comprising upper edges defining the upper surface of each header plate, said upper surface being coplanar with the upper peripheral surface portion of the casing body so as to be equal in height therewith, the upper edge portion being bent to an inverted L-shape such that the upper edge portion orthogonally abuts each of the side edge portions to define 90° corners, said upper lid is fitted so that it is brought into contact with the upper edges of the two side portions and the upper edge of the upper edge portion comprising the upper surface of the header plate over the entire length of the upper surface of each header plate, and contact portions between each part are integrally fixed by brazing.

* * * * *